United States Patent [19]

Oppenheimer

[11] Patent Number: 4,935,592

[45] Date of Patent: Jun. 19, 1990

[54] MICROWAVE COOKING CARTON FOR BROWNING AND CRISPING FOOD PRODUCTS

[76] Inventor: Douglas F. Oppenheimer, 2912 Gekeler La., Boise, Id. 83702

[21] Appl. No.: 279,746

[22] Filed: Dec. 5, 1988

[51] Int. Cl.[5] ..... H05B 6/80; B65B 25/22

[52] U.S. Cl. ..... 219/10.55 E; 219/10.55 F; 426/107; 426/234; 426/243; 99/DIG. 14

[58] Field of Search ..... 219/10.55 E, 10.55 F; 426/107, 113, 243, 241, 234; 99/DIG. 14

[56] References Cited

U.S. PATENT DOCUMENTS

| | | | |
|---|---|---|---|
| 3,943,320 | 3/1976 | Bowen | 219/10.55 E |
| 4,590,349 | 5/1986 | Brown et al. | 219/10.55 E |
| 4,676,857 | 6/1987 | Scharr et al. | 219/10.55 E |
| 4,703,148 | 10/1987 | Mikulski et al. | 219/10.55 E |
| 4,713,510 | 12/1987 | Quick et al. | 426/243 X |
| 4,748,308 | 5/1988 | Drews | 219/10.55 E |
| 4,775,771 | 10/1988 | Pawlowski et al. | 219/10.55 E |
| 4,777,053 | 10/1988 | Tobelmann et al. | 219/10.55 E |
| 4,820,893 | 4/1989 | Mode | 219/10.55 E |

*Primary Examiner*—Philip H. Leung

*Attorney, Agent, or Firm*—Larson and Taylor

[57] ABSTRACT

A microwavable package for browning the surface of a plurality of small food articles is disclosed. The package is disposable and includes an outer carton in which a microwave susceptor is housed. The susceptor is a unitary device which includes a plurality of compartments therein. Each compartment is sized to house a single food product and maintain physical contact between the susceptor means and a substantial portion of the food product. Upon heating in a microwave oven the physically-contacted portion of the surface of food product is browned or crisped to produce an aesthetically pleasing food.

5 Claims, 1 Drawing Sheet

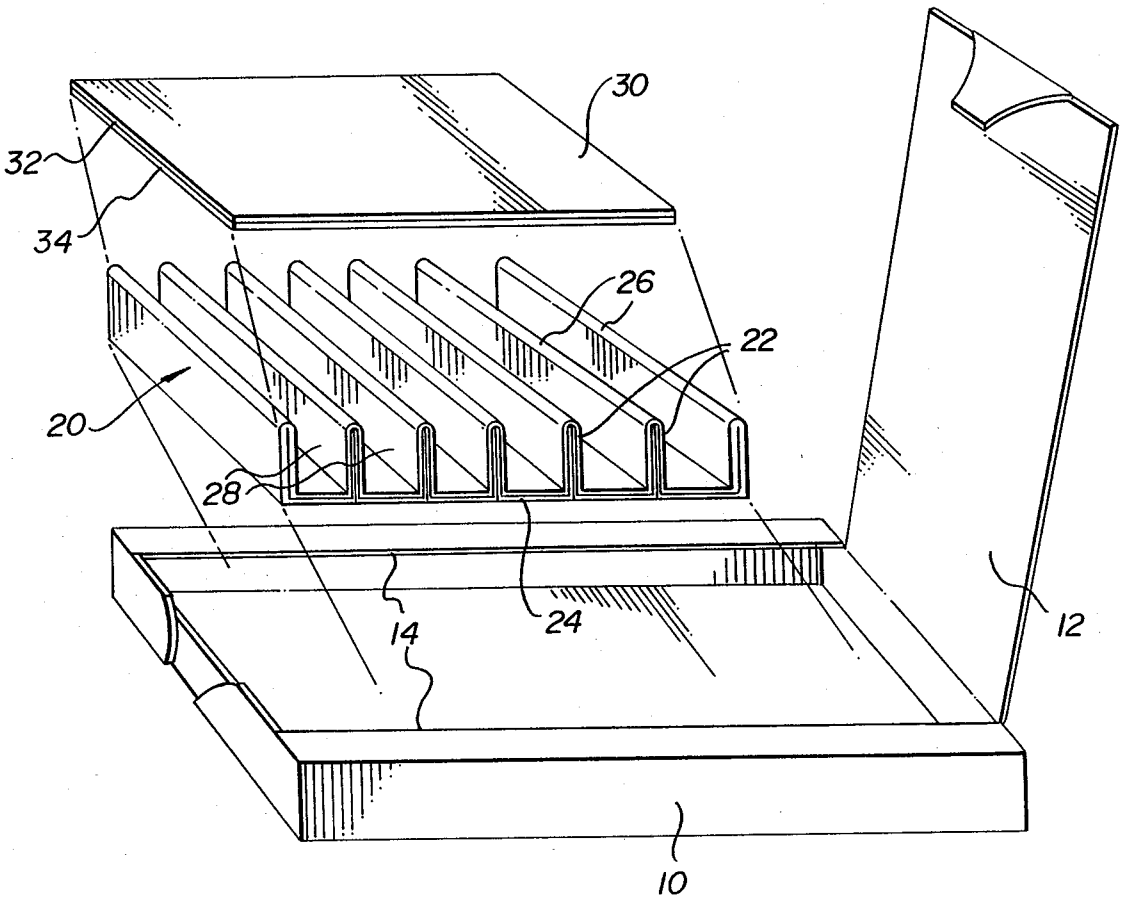
12
22
30
26
24
10
14
28
20
32
34

MICROWAVE COOKING CARTON FOR BROWNING AND CRISPING FOOD PRODUCTS

FIELD OF THE INVENTION

The present invention relates to food packaging suitable for use in a microwave oven. More particularly, it relates to a multi-purpose carton in which food, such as potato products, may be shipped, displayed, stored and cooked.

BACKGROUND OF THE INVENTION

Heating food in microwave ovens has become commonplace. It is widely recognized, however, that microwave energy fails to impart the proper amount of browning and/or crispness to foods normally expected to possess such a quality. Consequently, these foods, when cooked in a microwave oven, are not aesthetically appealing to the consumer.

Various attempts have been made to improve the browning or crispening of food when employing microwave heating. Such attempts have included incorporating into the microwave oven means to convert the high frequency microwave energy by resistive losses to heat energy. Additionally, edible coatings have been added to the food itself in order to induce browning and crispening and various utensils and dishes have been devised to promote browning.

One example of an apparatus designed to be employed in the microwave oven is shown in the U.S. Pat. No. 3,943,320 (Bowen) issued on Mar. 9, 1976. In this patent, a utensil for heating circular elongated objects such as hot dogs with microwave energy is disclosed. The utensil facilitates the browning and searing of the exterior surfaces of the food product and includes a plurality of searing members of a curved, tapered, substantially v-shaped configuration spaced from one another to encompass a portion of the elongated object to be heated. The searing means are supported on a microwave transparent frame of plastic material.

Another example of a device for use in a microwave oven is the microwave oven toaster disclosed in U.S. Pat. No. 4,748,308 issued on May 31, 1988. The microwave toaster includes a rectangular block of microwave transparent material including a plurality of parallel and aligned slots therein for receiving cards of material which absorb microwave energy and subsequently dissipate heat. In operation, two cards are inserted into two adjacent slots and a piece of bread is positioned between the two cards to absorb the heat dissipated therefrom to subsequently brown the bread.

Yet another example of an apparatus for use in a microwave oven is disclosed in U.S. Pat. No. 4,267,420 issued on May 12, 1981. This patent discloses a plastic film or other dielectric substrate having a thin coating thereon which controls the microwave conductivity when the package is placed in a conventional microwave oven. The plastic film and its coating may be wrapped around the food item and converts some of the microwave energy into heat which is then transmitted directly to the surface portion of the food item to cause browning and/or crispening.

In order to satisfy the needs of contemporary consumers, disposable containers are needed which, when used in a microwave oven, duplicate as closely as possible the cooking results of a conventional oven. Such containers should also serve as a shipping carton and display carton and be sufficiently economical to allow it to be disposable. Paperboard cartons satisfy many of these performance objectives but generally must be designed in accordance with requirements which are dependent on the type and quantity of the food to be placed and cooked in the container.

An example of a paperboard container designed for browning and crisping food is disclosed in U.S. Pat. No. 4,590,349 issued on May 20, 1986. This container includes a paperboard carton for heating and crisping two sides of food pieces having non-uniform dimensions in a microwave oven. The carton includes vertically spaced food supporting panels and a pair of microwave interactive layers associated with corresponding food supporting panels for converting microwave energy into heat for browning and crisping food pieces. The package also includes handles for allowing manual inversion of the container during the crisping and cooking process. This container suffers from several disadvantages, namely that it only browns food on two sides, that it requires inversion during the cooking process and that it is not practical for small food items wherein many units are incorporated in a single package.

Thus, there remains a need in the microwave container art for a cook-in container for foodstuffs and particularly for smaller foodstuffs which require browning and crispening, which is inexpensive, simple to manufacture, disposable and capable of browning substantially the entire surface of the food product.

SUMMARY OF THE INVENTION

The present invention relates to a microwavable package for food products which imparts a brown or crisp texture to a substantial portion of the food product surface upon exposure to microwave energy. The package includes a microwavable housing for enclosing at least one food product and at least one unitary microwave susceptor housed within said housing and being configured to form a plurality of compartments therein, each compartment being sized to enclose and physically contact a substantial portion of the surface of at least one unit of food product such that upon exposure to microwave energy a substantial portion of the surface of the food product becomes crisp or brown.

It is the primary object of the present invention to provide a disposable container for food products which may be used to brown and crisp food products in a microwave oven.

It is a further object of the present invention to provide a disposable container for food products designed to brown and crisp a plurality of small food products in a single container upon exposure to microwave energy.

These and other objects of the present invention will be apparent to one of ordinary skill in the art from the detailed description which follows.

BRIEF DESCRIPTION OF THE DRAWING

The single FIGURE is an exploded view of a microwavable package in accordance with the present invention.

DETAILED DESCRIPTION OF THE PREFERRED EMBODIMENTS

Referring now to the single FIGURE there shown one embodiment of a microwavable food package in a accordance with the present invention. The package includes a disposable carton 10 preferably made from paperboard or other inexpensive material. Carton 10 may include any suitable means for being opened such as tearable flap 12 adapted to tear along score lines 14.

The package also includes a unitary microwave susceptor means 20 adapted to fit inside carton 10 as shown by the dotted lines in the single FIGURE. Susceptor means 20 is preferably a two layered laminate material wherein the first layer 22 comprises a microwave susceptor material and second layer 24 may be of any suitable material depending upon the particular application. As shown in the single FIGURE, first and second layers 22, 24 include several folds 26 which form compartments 28 in susceptor means 20 for housing a food product. Susceptor means 20 may also include a cover sheet 30 preferably comprised of a first layer 32 of susceptor material and a second layer 34 of any suitable microwavable material.

In use, susceptor means 20 is located within carton 10. Susceptor means 20 may be suitably attached to the bottom of carton 10 or more preferably fits snugly in carton 10 and can be removed by the user if desired. Then, a food product such as french fries is packaged within susceptor means 20. Preferably, the french fries are aligned in compartments 28 and fit snugly within susceptor means 20 such that susceptor means 20 physically contacts a substantial portion of the surface of each french fry. Finally, cover means 30 may be placed atop the packaged french fries and carton 10 closed and sealed.

In use, the consumer merely opens carton 10 by tearing back flap 12 along the score lines 14 and places carton 10 in a microwave oven for the desired time period to cook the food product therein. Upon completion of cooking, the consumer removes the package from the microwave oven, removes cover means 30 from susceptor means 20 and may either remove the food product directly or remove the remaining portion of susceptor means 20 from package 10 if desired.

Carton 10 may be made of any suitable material and most preferably is a paperboard carton perhaps having a plastic coating on its surface. Susceptor means 20 may include two layers of different materials. First layer 22 comprises a material which converts microwaves into heat energy in some manner such as resistive heating. Second layer 22 may be any suitable material for the particular application and, for example may be a paperboard layer to impart additional rigidity to microwave susceptor means 20 so that it will maintain its configuration. Second layer 24 may also be a grease absorbing material or a grease resistant material if desired. Cover means 30 is preferably fabricated from the same materials as the remainder of susceptor means 20.

Susceptor means 20 is preferably flexible to allow insertion and removal of food products therefrom. This is facilitated by the flexibility of susceptor 20 since it is desired that food products fit snugly within susceptor means 20 to maximize physical contact between susceptor means 20 and the surface of the food product. Additionally, the flexibility of susceptor means 20 allows it to be inserted and removed from carton 10 even though it may be larger than the top opening of carton 10. Some degree of rigidity is preferably maintained in susceptor means 20 in order to minimize physical damage to the food products during transportation. Thus, the most preferred susceptor means 20 is semi-rigid to allow insertion and removal of food products with a snug fit while retaining its general shape to prevent crushing or physical damage to food products.

Susceptor means 20 may be fabricated in any suitable shape depending upon the particular food product to be packaged. For example, for a bite size potato product such as Tater Tots$_{tm}$ susceptor means 20 includes several compartments 28 sized to house bite-sized potato products and maintain physical contact between susceptor means 20 and the surface of the bite-sized potato products. In addition, the materials from which susceptor means 20 are made may be any suitable material for placement in the microwave oven so long as susceptor means 20 includes at least one material which converts microwave energy into heat to accomplish browning or crisping of the surface of the food product being cooked. Cover sheet 30 is optional and may be excluded if crispness is only desired on 75% of food product surface . Cover sheet 30 provides browning or crisping on the top surface of the food product not contacted by the remaining portion of susceptor means 20.

Susceptor means 20 of the present invention exhibits several advantages over prior art susceptor means. First, it may be fabricated in an inexpensive manner such that disposable packages for browning and crisping foods are economically feasible. Secondly, it provides a means for browning or crisping a plurality of small food products which are packaged in the same container, such as french fries, potato bites, egg rolls or other small food products of which a plurality are generally consumed in one sitting. Further, this design for a disposable microwavable package is highly flexible and can be adapted to food products of any shape and a plurality of different sizes.

The foregoing description of the invention has been presented for purposes of illustration and description only and many modifications and variations will be apparent one of ordinary skill in the art. Accordingly, the scope of the invention is to be defined by the claims appended hereto.

What is claimed is:

1. A microwavable package for food products which imparts a brown or crisp texture to a substantial portion of the food product surface upon exposure to microwave energy comprising:

a microwavable housing for enclosing at least one food product; and a single unitary microwave susceptor housed within said housing and being configured to form a plurality of U-shaped channels therein, each U-shaped channel being formed by a plurality of folds in said single unitary microwave susceptor, said folds forming double-layered walls defining said U-shaped channels, wherein the height of said folds is sufficient to enclose and physically contact a substantial portion of the surface of at least one unit of food product such that upon exposure to microwave energy a substantial portion of the surface of the food product becomes crisp or brown.

2. A package as claimed in claim 1 wherein said susceptor means may also include a cover sheet comprised of a first layer of susceptor material and a second layer of any suitable microwavable material.

3. A package as claimed in claim 2 wherein said microwave susceptor comprises a material which is at least semi-rigid in order to maintain the integrity of the package.

4. A package as claimed in claim 3 wherein said microwave susceptor comprises a rigid material which maintains the integrity of said channels to thereby prevent physical deformation of the food product contained therein.

5. A package as claimed in claim 2 wherein said microwave susceptor comprises a resilient material which allows removal of the food product from said channels without damage to the food product.

* * * * *